US010730305B2

(12) United States Patent
Mu et al.

(10) Patent No.: US 10,730,305 B2
(45) Date of Patent: Aug. 4, 2020

(54) INKJET PRINTING SYSTEM WITH NON-CONTACT CLEANING STATION

(71) Applicant: RF Printing Technologies LLC, Pittsford, NY (US)

(72) Inventors: Richard Mu, Irvine, CA (US); Yonglin Xie, Rochester, NY (US)

(73) Assignee: SHANGHAI REALFAST DIGITAL TECHNOLOGY CO., LTD, Shanghai (CN)

( * ) Notice: Subject to any disclaimer, the term of this patent is extended or adjusted under 35 U.S.C. 154(b) by 0 days.

(21) Appl. No.: 16/214,238

(22) Filed: Dec. 10, 2018

(65) Prior Publication Data

US 2019/0105907 A1 Apr. 11, 2019

Related U.S. Application Data

(63) Continuation of application No. 15/496,539, filed on Apr. 25, 2017, now Pat. No. 10,179,454.

(51) Int. Cl.
*B41J 2/165* (2006.01)

(52) U.S. Cl.
CPC ..... *B41J 2/16552* (2013.01); *B41J 2/16538* (2013.01); *B41J 2/16585* (2013.01); *B41J 2002/16558* (2013.01)

(58) Field of Classification Search
CPC .. B41J 2/16552; B41J 2/1721; B41J 2/16538; B41J 2/16585
See application file for complete search history.

(56) References Cited

U.S. PATENT DOCUMENTS

| | | | |
|---|---|---|---|
| 4,600,928 | A | 7/1986 | Braun et al. |
| 4,970,535 | A | 11/1990 | Oswald et al. |
| 5,574,485 | A | 11/1996 | Anderson et al. |
| 6,145,952 | A | 11/2000 | Sharma et al. |
| 6,196,657 | B1 | 3/2001 | Hawkins et al. |
| 6,511,155 | B1 | 1/2003 | Fassler et al. |
| 6,513,903 | B2 | 2/2003 | Sharma et al. |
| 6,572,215 | B2 | 6/2003 | Sharma |
| RE39,242 | E | 8/2006 | Johnson et al. |
| 7,344,231 | B2 | 3/2008 | Talon et al. |
| 7,798,598 | B2 | 9/2010 | Horie |
| 7,918,530 | B2 | 4/2011 | Kanfoush et al. |
| 9,358,791 | B2 * | 6/2016 | Schneider ..... B41J 2/16535 |

(Continued)

*Primary Examiner* — Jason S Uhlenhake
(74) *Attorney, Agent, or Firm* — Gary A. Kneezel

(57) ABSTRACT

An inkjet printing system includes an printhead with a nozzle face having nozzles arranged along an array direction. A pressure source is configured to provide a positive or negative pressure to an ink source. A valve is fluidically connected between the ink source and the inkjet printhead. A cleaning station is configured to confront the nozzle face across a gap. The cleaning station includes a cleaning fluid dispenser for dispensing cleaning fluid onto the nozzle face. The cleaning station includes a waste fluid collector having a vacuum inlet that is displaced from the cleaning fluid dispenser in a first direction for collecting dispensed cleaning fluid. The cleaning station includes a blower that is displaced from the cleaning fluid dispenser in a second direction opposite to the first direction. The blower is configured to direct a gas stream along the nozzle face to move dispensed cleaning fluid toward the vacuum inlet.

11 Claims, 9 Drawing Sheets

(56) References Cited

U.S. PATENT DOCUMENTS

| | | | | |
|---|---|---|---|---|
| 2004/0066427 | A1* | 4/2004 | West | B41J 2/16552 347/22 |
| 2014/0009534 | A1* | 1/2014 | Yamamoto | B41J 2/16526 347/35 |
| 2014/0132666 | A1* | 5/2014 | Elferink | B41J 2/16511 347/30 |
| 2016/0089897 | A1 | 3/2016 | Nishiyama | |
| 2016/0288518 | A1* | 10/2016 | Ando | B41J 2/17566 |

* cited by examiner

FIG. 1 – PRIOR ART

INKJET PRINTING SYSTEM WITH NON-CONTACT CLEANING STATION

CROSS REFERENCE TO RELATED APPLICATIONS

This application is a continuation application of U.S. application Ser. No. 15/496,539 filed Apr. 25, 2017.

FIELD OF THE INVENTION

This invention pertains to the field of inkjet printing and more particularly to effective and gentle cleaning of the nozzles of the printhead.

BACKGROUND OF THE INVENTION

Inkjet printing is typically done by either drop-on-demand or continuous inkjet printing. In drop-on-demand inkjet printing ink drops are ejected onto a recording medium using a drop ejector including a pressurization actuator (thermal or piezoelectric, for example). Selective activation of the actuator causes the formation and ejection of a flying ink drop that crosses the space between the printhead and the recording medium and strikes the recording medium. The formation of printed images is achieved by controlling the individual formation of ink drops, as is required to create the desired image.

Motion of the recording medium relative to the printhead during drop ejection can consist of keeping the printhead stationary and advancing the recording medium past the printhead while the drops are ejected, or alternatively keeping the recording medium stationary and moving the printhead. The former architecture is appropriate if the drop ejector array on the printhead can address the entire region of interest across the width of the recording medium. Such printheads are sometimes called pagewidth printheads. A second type of printer architecture is the carriage printer, where the printhead drop ejector array is somewhat smaller than the extent of the region of interest for printing on the recording medium and the printhead is mounted on a carriage. In a carriage printer, the recording medium is advanced a given distance along a medium advance direction and then stopped. While the recording medium is stopped, the printhead carriage is moved in a carriage scan direction that is substantially perpendicular to the medium advance direction as the drops are ejected from the nozzles. After the carriage-mounted printhead has printed a swath of the image while traversing the print medium, the recording medium is advanced; the carriage direction of motion is reversed; and the image is formed swath by swath.

A drop ejector in a drop-on-demand inkjet printhead includes a pressure chamber having an ink inlet for providing ink to the pressure chamber, and a nozzle for jetting drops out of the chamber. Two side-by-side drop ejectors are shown in prior art FIG. 1 (adapted from U.S. Pat. No. 7,163,278) as an example of a conventional thermal inkjet drop-on-demand drop ejector configuration. Partition walls 20 are formed on a base plate 10 and define pressure chambers 22. A nozzle plate 30 is formed on the partition walls 20 and includes nozzles 32 (also called orifices herein), each nozzle 32 being disposed over a corresponding pressure chamber 22. The exterior surface of a nozzle plate 30 is called a nozzle face 114 herein. Ink enters pressure chambers 22 by first going through an opening in base plate 10, or around an edge of base plate 10, and then through ink inlets 24, as indicated by the arrows in FIG. 1. A heating element 35, which functions as the actuator, is formed on the surface of the base plate 10 within each pressure chamber 22. Heating element 35 is configured to selectively pressurize the pressure chamber 22 by rapid boiling of a portion of the ink in order to eject drops of ink through the nozzle 32 when an energizing pulse of appropriate amplitude and duration is provided.

During the printing process ink residue can collect on the nozzle face and within the nozzles and cause total or partial blockage of nozzles that can result in missing drops, small drops or misdirected drops of ink, thereby degrading print quality. To overcome this, a maintenance station is commonly used in order to clean the nozzles and to slow the evaporation of the volatile components of the ink. Maintenance stations typically include capability for exerting a pressure differential at the nozzle face to withdraw ink from the nozzles in order to prime the nozzles and remove blockages due to dried or viscous ink, air bubbles or particulates. While nozzle priming is effective in cleaning, it generally uses excessive amounts of ink and preferably should only be done infrequently. Periodic ejection of ink droplets, sometimes called spitting, while the printhead is at the maintenance station uses relatively small amounts of ink and is effective for removing some viscous ink plugs and some dried ink, but it is not effective in removing larger or more tenaciously adhering obstructions.

Many inkjet printing systems have maintenance stations that use wiping of the nozzle face to remove ink residue and other debris. Wipers are typically made of elastomeric materials for rubbing or soft absorbent materials for blotting. Over an extended period of time, wiping of the nozzles can cause damage to the nozzle face. Even though the wipers themselves may be soft, they can drag particulates across the nozzle face resulting in abrasion. For nozzle faces having an ink repellent coating, extended wiping can change the wettability of the nozzle face. Over a period of time the damage to the nozzle face can cause permanent damage that degrades print quality to the extent that the printhead needs to be replaced. Furthermore, wiping can smear ink residue or particulates into the nozzles, which can cause nozzle clogging or jet misdirection.

Developments within the inkjet printing industry have increased the importance of maintenance that is effective in cleaning nozzles without damaging the nozzle face. One development is the increasing use of inks that have more desirable printing characteristics on the print medium. An example is waterfast pigment-based inks. Pigments are not soluble in the ink carrier medium, such as water, so they are not easily washed away if a printed paper gets wet. Pigments also remain near the surface of the paper without diffusing outward as in the case of dye-based inks, so that edges of printed features are more well-defined. To provide higher contrast in printed images, pigment-based inks with high solids content are used together with a dispersant. To provide finer details in printed images, printheads having smaller nozzles are used in order to eject smaller drops. The qualities that can make the pigment-based inks desirable for printing, such as insolubility in the ink carrier medium, can make them more difficult to remove from the nozzles and nozzle face. The pigment particles can more easily clog small nozzles as volatile components of the ink evaporate. In addition, the dispersant in the ink can form a film on the nozzle face that can make dust and debris stick to the nozzle face. Furthermore, specialty inks such as inks for functional printing of electronic components, or inks for 3D printing can have ink components that form residues that are difficult to remove.

A second development within the inkjet printing industry is the increased use of commercial printing. Commercial inkjet printers are capable of printing high volumes of pages at high printing throughput. The printheads are typically pagewidth printheads and are relatively expensive. Although the printheads can be replaced, replacement incurs additional costs for printhead components and system servicing. In addition, it causes undesirable downtime for the commercial printing system. Cleaning methods are needed that can effectively remove tenacious nozzle clogs and ink residue films without shortening printhead lifetime.

A variety of non-contact cleaning systems and methods have been disclosed in the prior art for cleaning the nozzle face of an inkjet printhead without physical contact of a wiper or blotter. U.S. Pat. No. 5,574,485 discloses a cleaning solution that is held within a cleaning nozzle by surface tension to form a meniscus that is caused to bulge into contact with the printhead nozzle face and form a bridge of cleaning solution. The cleaning solution is ultrasonically excited by a piezoelectric material immediately upstream of the cleaning nozzle to provide a high frequency energized liquid meniscus to facilitate viscous plug removal without having mechanical contact with the nozzle face. Vacuum nozzles are positioned near the cleaning nozzle to remove the deposited cleaning solution together with any ink dissolved therein.

U.S. Pat. No. 4,600,928 discloses an inkjet printing apparatus having a cleaning system where ink is supported near the nozzle, and ultrasonic cleaning vibrations are imposed on the supported ink mass. Such cleaning using the ink itself can be implemented with ink cross-flowing through the printhead cavity or in cooperation with a varying pressure differential to cause ink to oscillate inwardly and outwardly within the nozzles.

U.S. Pat. No. 4,970,535 discloses an inkjet printhead face cleaner that provides a controlled air passageway through an enclosure formed against the printhead face. Air is directed through an inlet into a cavity in a body. The body has a face that is placed in sealing contact against the printhead face. The air is directed through the cavity past the inkjet nozzles and out through an outlet. A vacuum source can be attached to the outlet to further seal the two faces together. A collection chamber is positioned below the outlet to facilitate disposing of removed ink.

U.S. Pat. No. 6,196,657 discloses a cleaning assembly that is disposed proximate the printhead surface for directing a flow of fluid along the surface and across at least one nozzle in order to clean contaminants from the surface and the at least one nozzle. The cleaning assembly has a cup that includes a cavity and surrounds the at least one nozzle. The cleaning assembly includes a valve system in fluid communication with the cavity for allowing a fluid flow stream consisting of alternating segments of at least one liquid cleaning agent from a liquid cleaning agent source and another element such as a gas from a gas source or a second liquid cleaning agent from a liquid cleaning agent source into the cavity.

U.S. Pat. No. 6,145,952 discloses a cleaning assembly disposed relative to the printhead surface or nozzle for directing a flow of fluid along the surface or across the nozzle to clean the particulate matter from the surface or nozzle. The cleaning assembly includes a septum disposed opposite the surface or nozzle for defining a gap therebetween. Presence of the septum accelerates the flow of fluid through the gap to introduce a hydrodynamic shearing force in the fluid. This shearing force acts against the particulate matter to clean the particulate matter from the surface or nozzle. A pump in fluid communication with the gap is also provided for pumping the fluid through the gap. As the surface or orifice is cleaned, the particulate matter is entrained in the fluid. A filter is provided to separate the particulate matter from the fluid. U.S. Pat. No. 6,513,903 discloses a self-cleaning printer with a printhead having an orifice plate defining an inkjet orifice, a cleaning orifice and a drain orifice. The orifice plate further defines an outer surface between the orifices. A source of pressurized cleaning fluid is connected to the cleaning orifice and a fluid return is connected to the drain orifice for storing used cleaning fluid. A cleaning surface is disposed adjacent to and separate from the outer surface to define a capillary fluid flow path from the cleaning orifice across the inkjet orifice and to the drain orifice.

U.S. Pat. No. 6,572,215 discloses a self-cleaning printhead including a printhead body having an outer surface defining an inkjet orifice. A source of pressurized cleaning fluid is provided to generate a flow of cleaning fluid at the outer surface during cleaning. A fluid drain is provided to receive the flow of cleaning fluid. A movable flow guide defines a flow path from the source of pressurized cleaning fluid along the outer surface and inkjet orifice and to the fluid drain. During cleaning, a translation drive moves the flow guide along a path that diverges from the flow path.

U.S. Pat. No. 6,511,155 discloses a cleaning apparatus for cleaning debris from orifices in an inkjet printhead nozzle plate. The cleaning apparatus includes a structure defining a cleaning cavity between two horizontally contacting rollers where cleaning liquid is loaded, agitated, and dynamically sealed in the cavity through the rotation of the rollers. A relative movement is also provided between the nozzle plate and the cleaning structure so that the nozzle plate can be positioned above the cleaning cavity with the rotating rollers. The nozzle plate is spaced a small distance from the flow of the cleaning liquid so that cleaning fluid fills the small distance. The flow causes the cleaning fluid to engage the nozzle plate and remove debris from the nozzle plate and nozzles. After the cleaning cycle has ended the cleaning fluid is discarded.

U.S. Pat. No. RE39,242 discloses a wet-wiping printhead cleaning system including a treatment fluid applicator that places treatment fluid on at least one of the printhead nozzle face and a wiper. Treatment fluid is applied before wiping the printhead by projecting treatment fluid through the atmosphere, thereby avoiding direct contact between the applicator and the nozzle face or the wiper. The treatment fluid lubricates the wiper so as to lengthen wiper service life and enhance wiping performance, and makes the accumulated residue more removable by wiping.

U.S. Pat. No. 7,798,598 discloses a nozzle cleaning unit that includes a wiping portion. The wiping portion is moved to adjust a gap between the wiping portion and a printhead. Contact cleaning or non-contact cleaning is selected at the time of cleaning. The wiper is more wettable than the nozzle face, which has an ink repellent coating. In non-contact cleaning the wiper is brought close enough to the nozzle face that ink on the nozzle face contacts the wiper and is drawn to the wiper. As a result, there is less frequent contact between the wiper and the nozzle face so that abrasion of the ink repellent coating is reduced.

U.S. Pat. No. 7,918,530 discloses an embodiment where an inkjet printhead is cleaned by two operations. A first operation is forcibly ejecting ink through the inkjet nozzles to clean nozzles that may be blocked or partially clogged. The forcible ejecting of ink also entrains debris from the nozzle face. A second operation is directing a stream of a pressurized cleaning fluid across a surface of the inkjet printhead. Dried ink and debris are loosened by the force and possibly the chemical composition of the stream and are removed from the nozzle face.

U.S. Pat. No. 7,344,231 discloses an embodiment in which a cleaning station includes a tray containing a solvent. A rotary cleaning blade in the cleaning station is soaked in the solvent and then rotates in order to scrape the outer surface of the printhead to unblock nozzles. The cleaning station also includes a resilient wiping blade that scrapes the outer surface of the printhead in order to wipe or dry the nozzles after passage of the cleaning blade and remove residual dirt.

Despite the previous advances in non-contact cleaning of nozzle faces of inkjet printheads, what is still needed are printing system designs and cleaning methods that employ cleaning fluids while preventing excessive mixing of cleaning fluid with ink in the ink supply. What is also needed are printing system designs and cleaning methods that direct air toward and across the nozzle face without depriming nozzles. What is further needed are cleaning station designs and cleaning methods having improved effectiveness in removing residual cleaning fluid and ink without contacting the nozzle face in regions where nozzles are located.

SUMMARY OF THE INVENTION

According to an aspect of the present invention, an inkjet printing system includes an inkjet printhead with a nozzle face having nozzles arranged along an array direction. An ink source provides ink to the printhead. A controller controls the operations of the inkjet printing system. A pressure source is configured to controllably provide a positive pressure or a negative pressure to the ink source. A valve is fluidically connected between the ink source and the inkjet printhead. The valve includes an on position and an off position, where the on position and the off position are controllably selectable. A cleaning station is configured to confront the nozzle face across a gap. The cleaning station includes a cleaning fluid dispenser containing a cleaning fluid and at least one opening for dispensing cleaning fluid onto the nozzle face. The cleaning station also includes a waste fluid collector having a vacuum inlet that is displaced from the cleaning fluid dispenser in a first direction for collecting dispensed cleaning fluid, where the vacuum inlet has a first edge that is proximate to the cleaning fluid dispenser and a second edge that is distal to the cleaning fluid dispenser. The cleaning station further includes a blower that is displaced from the cleaning fluid dispenser in a second direction opposite to the first direction, where the blower is configured to direct a gas stream along the nozzle face to move dispensed cleaning fluid toward the vacuum inlet.

According to another aspect of the present invention, a method is provided for using a cleaning station to clean a nozzle face of an inkjet printhead that is fluidically connected to an ink source and to a pressure source through a valve. The method includes applying a positive pressure to the ink source from the pressure source to cause ink to weep from nozzles that are arranged in a nozzle region along an array direction in the nozzle face. The valve is then closed to stop the weeping of ink and to prevent siphoning through the nozzles. Cleaning fluid is dispensed onto the nozzle face. The dispensed cleaning fluid is blown along the nozzle face to mix with contaminants to produce waste fluid. A vacuum source that is connected to a vacuum inlet of a waste collector is turned on. The waste fluid is vacuumed through the vacuum inlet. Dispensing of cleaning fluid and blowing of dispensed cleaning fluid are then ceased and the vacuum source is turned off. A negative pressure is applied to the ink source from the pressure source and the valve is opened in preparation for printing.

This invention has the advantage that a gentle and effective nozzle cleaning system and method are provided for sustained high quality printing without damaging the nozzle face. A further advantage is that excessive amounts of ink are not wasted during the nozzle cleaning operation.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 2:
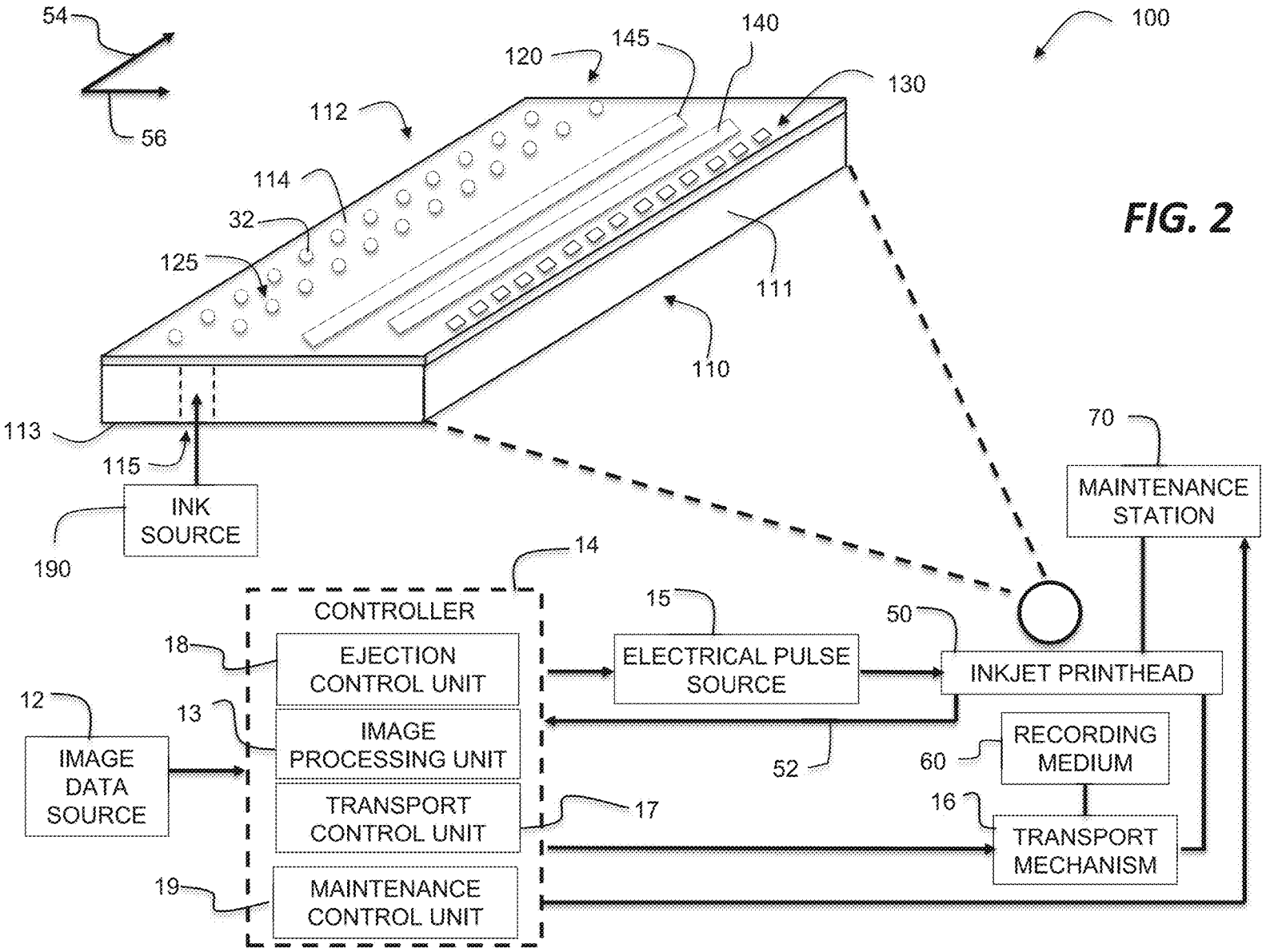
FIG. 2 is a schematic representation of an inkjet printing system according to an embodiment.

FIG. 2 shows a schematic representation of an inkjet printing system 100 together with a perspective of drop ejector array module 110, according to an embodiment of the present invention. Drop ejector array module 110 can also be called a printhead die. Image data source 12 provides image data signals that are interpreted by a controller 14 as commands for ejecting drops. Controller 14 includes an image processing unit 13 for rendering images for printing. The term "image" is meant herein to include any pattern of dots directed by the image data. It can include graphic or text images. It can also include patterns of dots for printing functional devices or three dimensional structures if appropriate inks are used. Controller 14 also includes a transport control unit 17 for controlling transport mechanism 16 and an ejection control unit 18 for ejecting ink drops to print a pattern of dots corresponding to the image data on the recording medium 60. Controller 14 sends output signals to an electrical pulse source 15 for sending electrical pulse waveforms to an inkjet printhead 50 that includes at least one drop ejector array module 110. A printhead output line 52 is provided for sending electrical signals from the printhead 50 to the controller 14 or to sections of the controller 14, such as the ejection control unit 18. For example, printhead output line 52 can carry a temperature measurement signal from printhead 50 to controller 14. Transport mechanism 16 provides relative motion between inkjet printhead 50 and recording medium 60 along a scan direction 56. Transport mechanism 16 is configured to move the recording medium 60 along scan direction 56 while the printhead 50 is stationary in some embodiments. Alternatively, transport mechanism 16 can move the printhead 50, for example on a carriage, past stationary recording medium 60. Various types of recording media for inkjet printing include paper, plastic, and textiles. In a 3D inkjet printer, the recording media include a flat building platform and a thin layer of powder material. In addition, in various embodiments recording medium 60 can be web fed from a roll or sheet fed from an input tray.

Figure 1:
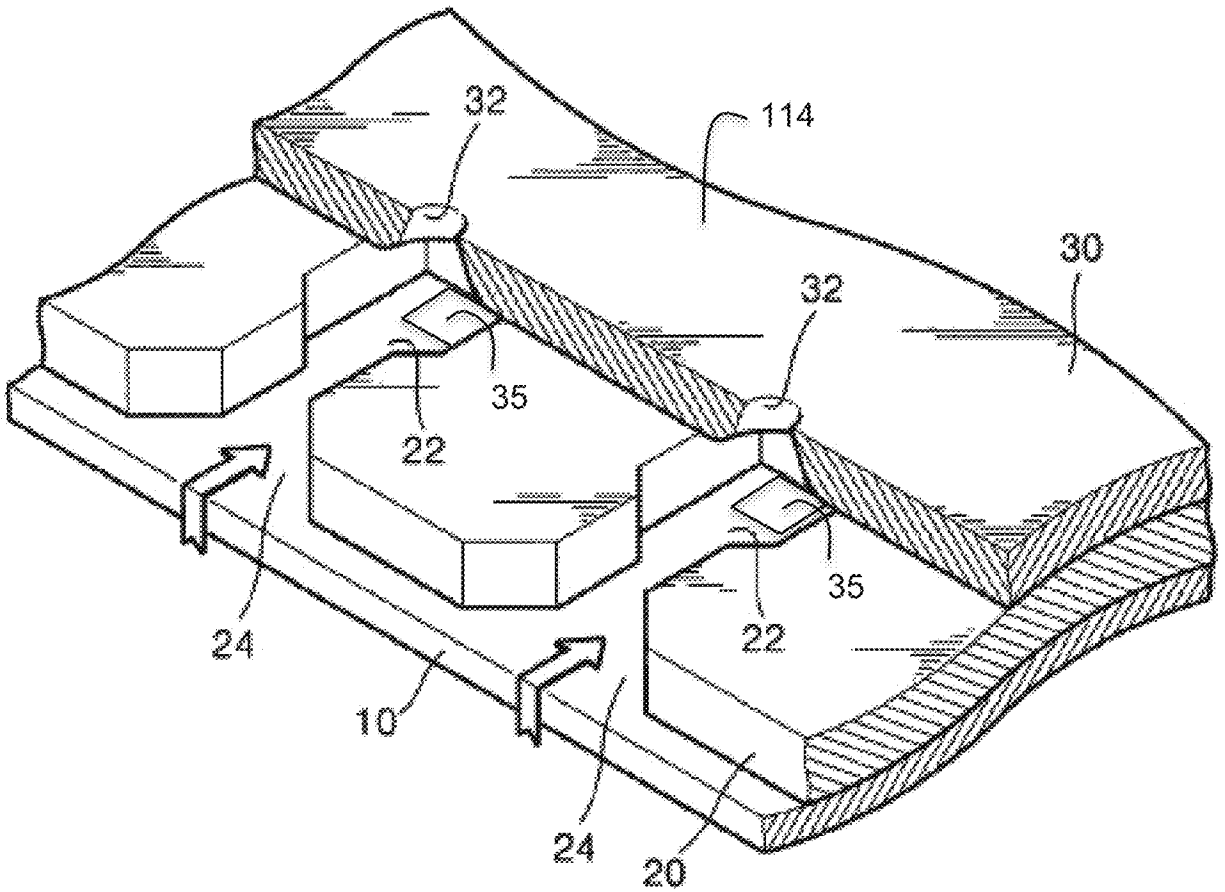
FIG. 1 shows a perspective of a prior art drop ejector configuration.

Drop ejector array module 110 includes at least one drop ejector array 120 having a plurality of drop ejectors 125 formed on a top surface 112 of a substrate 111 that can be made of silicon or other appropriate material. In the example shown in FIG. 2, drop ejector array 120 includes a pair of rows of drop ejectors 125 that extend along array direction 54 and that are staggered with respect to each other in order to provide increased printing resolution. Ink is provided to drop ejectors 125 by ink source 190 through ink feed 115 which extends from the back surface 113 of substrate 111 toward the top surface 112. Ink source 190 is generically understood herein to include any substance that can be ejected from an inkjet printhead drop ejector. Ink source 190 can include colored ink such as cyan, magenta, yellow or black. Alternatively ink source 190 can include conductive material, dielectric material, magnetic material, or semiconductor material for functional printing. Ink source 190 can alternatively include biological or other materials. For simplicity, location of the drop ejectors 125 is represented by the circular nozzle 32. Nozzle face 114 is the exterior surface through which the nozzles 32 extend. Not shown in FIG. 2 are the pressure chamber 22, the ink inlet 24, or the actuator 35 (FIG. 1). Ink inlet 24 is configured to be in fluidic communication with ink source 190. The pressure chamber 22 is in fluidic communication with the nozzle 32 and the ink inlet 24. The actuator 35, e.g. a heating element or a piezoelectric element, is configured to selectively pressurize the pressure chamber 22 for ejecting ink through the nozzle 32. Drop ejector array module 110 includes a group of input/output pads 130 for sending signals to and sending signals from drop ejector array module 110 respectively. Also provided on drop ejector array module 110 are logic circuitry 140 and driver circuitry 145. Logic circuitry 140 processes signals from controller 14 and electrical pulse source 15 and provides appropriate pulse waveforms at the proper times to driver circuitry 145 for actuating the drop ejectors 125 of drop ejector array 120 in order to print an image corresponding to data from image processing unit 13. Logic circuitry 140 sequentially selects one or more drop ejectors in the drop ejector array to be actuated. Groups of drop ejectors 125 in the drop ejector array are fired sequentially so that the capacities of the electrical pulse source 15 and the associated power leads are not exceeded. A group of drop ejectors 125 is fired during a print cycle. A stroke is defined as a plurality of sequential print cycles, such that during a stroke all of the drop ejectors 125 of drop ejector array 120 are addressed once so that they have opportunity to be fired once based upon the image data. Logic circuitry 140 can include circuit elements such as shift registers, gates and latches that are associated with inputs for functions including providing data, timing, and resets.

Figure 3:
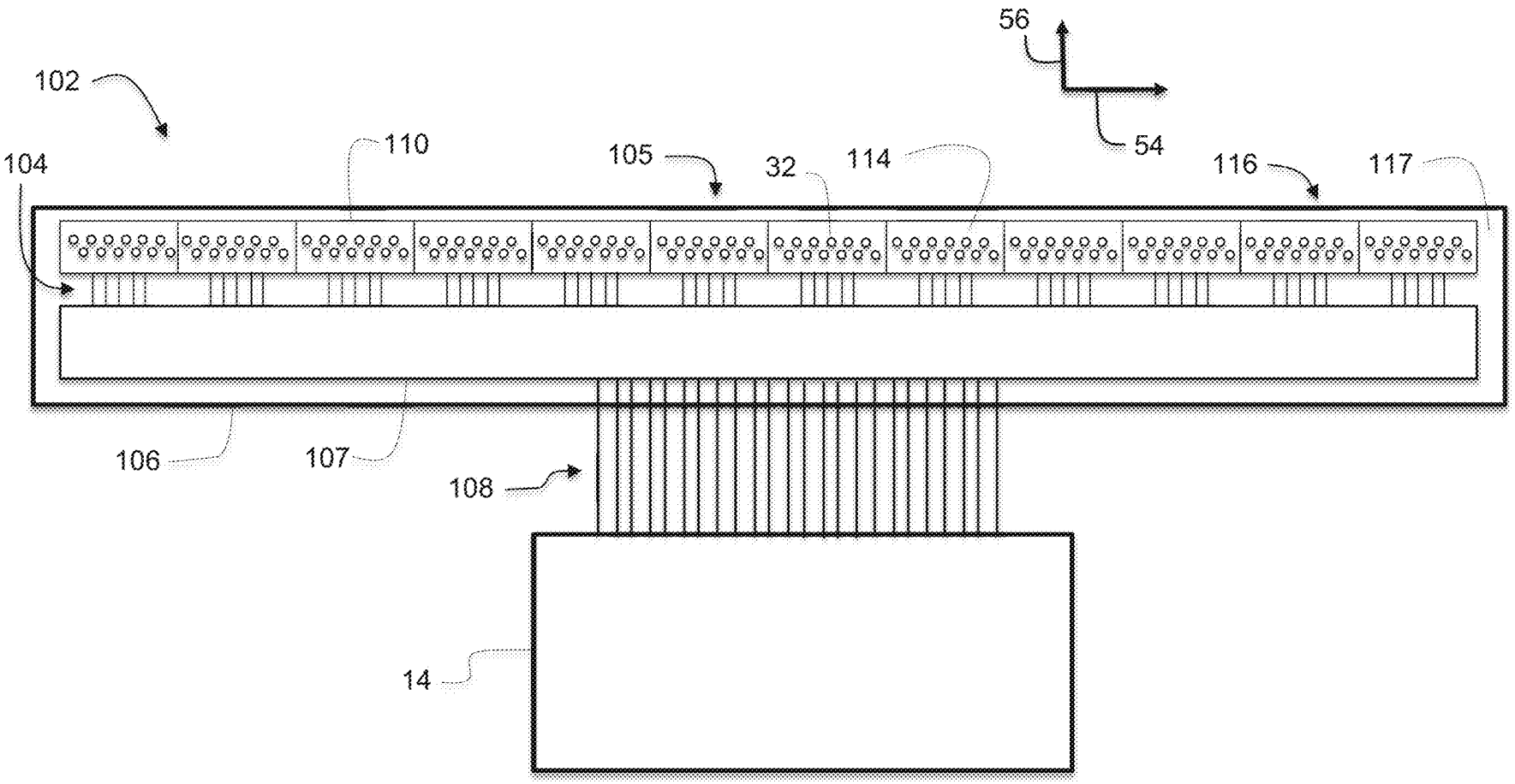
FIG. 3 shows a schematic of a portion of an inkjet printing system having a pagewidth printhead with a plurality of drop ejector array modules.

Maintenance station 70 keeps the drop ejectors 125 of drop ejector array module 110 on printhead 50 in proper condition for reliable printing. In embodiments described below, maintenance operations performed by maintenance station 70 include dispensing cleaning fluid onto the nozzle face 114 of drop ejector array module 110, blowing the dispensed cleaning fluid along the nozzle face 114, and suctioning the cleaning fluid that has been blown along the nozzle face 114 in order to clean nozzles 32 and remove ink residue and other debris. Maintenance operations can also include applying suction to the drop ejector array 120 in order to prime the nozzles. Maintenance operations can also include spitting, i.e. the firing of non-printing ink drops into a reservoir in order to provide fresh ink to the pressure chambers and the nozzles, for example if the drop ejectors have not been fired recently. Volatile components of the ink can evaporate through the nozzle over a period of time and the resulting increased viscosity can make jetting unreliable. During times when printing does not occur, a cap included in the maintenance station 70 can provide a seal surrounding nozzles on the nozzle face 114 in order to slow the evaporation of volatile ink components from the nozzles 32. The various maintenance operations are performed under the control of maintenance control unit 19 in controller 14. Simple conventional maintenance stations including wiping are appropriate for inexpensive conventional desktop inkjet printers for printing documents. The number of prints that are made during the lifetime of the printer is small enough that wiper-associated damage is not an issue. Even if the printhead is damaged, it is typically inexpensive to replace. Downtime is typically not a major issue for inexpensive desktop inkjet printers. However, for specialty ink printers or for commercial inkjet printers having expensive pagewidth printheads, more complex printhead maintenance systems can be more appropriate. FIG. 3 shows a schematic of a portion of an inkjet printing system 102 having a pagewidth printhead 105 including a plurality of drop ejector array modules 110 that are arranged end to end along array direction 54 and affixed to mounting substrate 106. (It is understood herein that the more general term printhead 50 can also include pagewidth printheads 105.) Nozzle face 114 has nozzles 32 arranged along array direction 54. Nozzles 32 are arranged in a nozzle region 116 on pagewidth printhead 105. In this example where the drop ejector array modules 110 are arranged end to end on mounting substrate 106, nozzle region 116 corresponds to the nozzle faces 114 on all of the drop ejector array modules 110. A second region 117 outside the nozzle region 116 is beyond the drop ejector array modules 110. An interconnection board 107 is mounted on mounting substrate 106 and is connected to each of the drop ejector array modules 110 by interconnects 104 that can be wire bonds or tape automated bonding leads for example. A printhead cable 108 connects the interconnection board 107 to the controller 14. Maintenance station 70 (FIG.

2) is not shown in FIG. 3. In embodiments described below, during maintenance operations a cleaning station 200 in maintenance station 70 is configured to confront the nozzle faces 114 of drop ejector array modules 110 across a gap. Recording medium 60 (FIG. 2) is moved along scan direction 56 by transport mechanism 16 (FIG. 2) for printing. Controller 14 controls the various functions of the inkjet printing system as described above with reference to FIG. 2.

Figure 4:
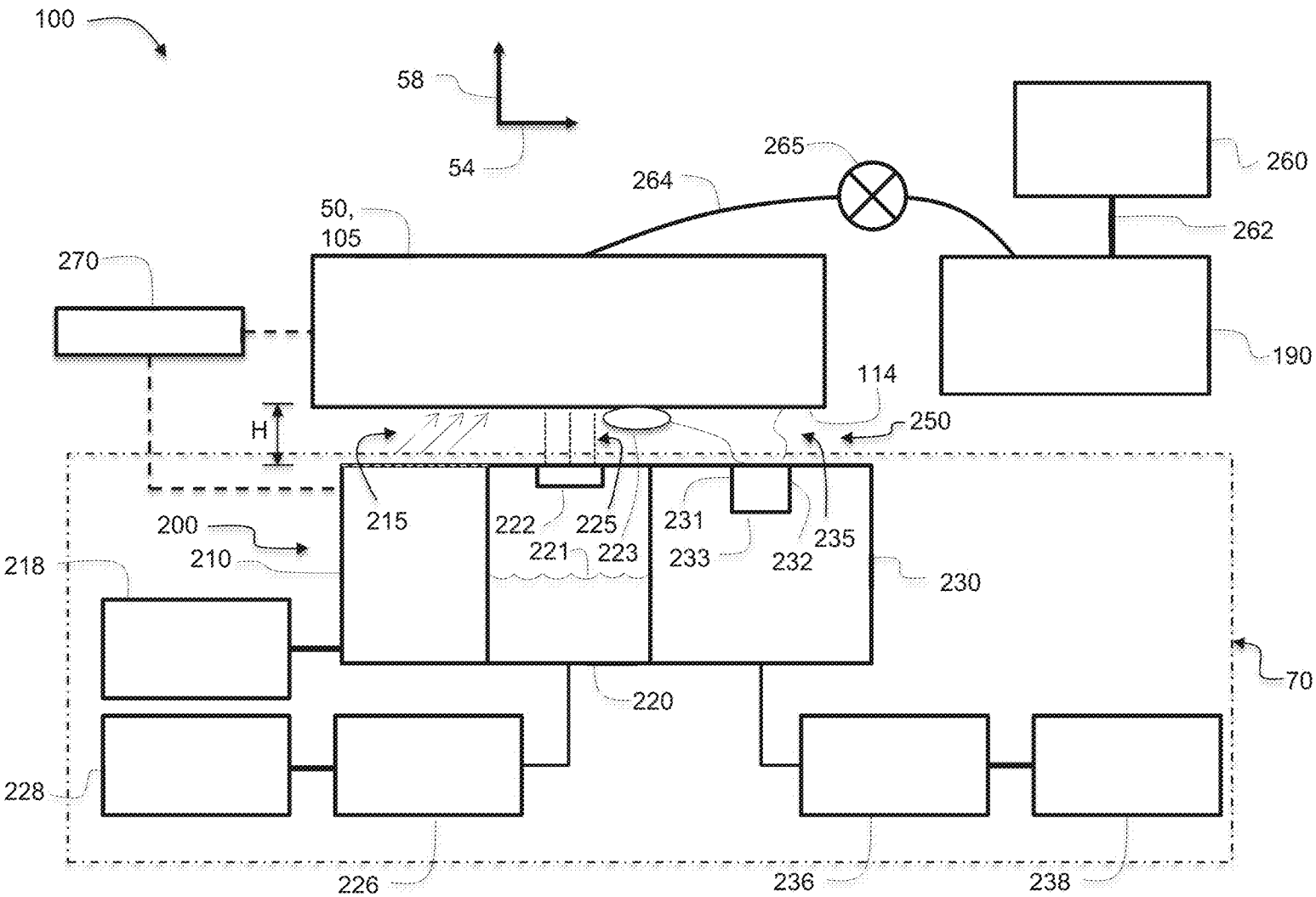
FIG. 4 shows a schematic of a portion of an inkjet printing system including a cleaning station according to an embodiment of the invention.

FIG. 4 shows a schematic of a portion of inkjet printing system 100 according to an embodiment of the invention. Printhead 50 can be a pagewidth printhead 105 as described above with reference to FIG. 3. Components of maintenance station 70 according to the embodiment are shown in more detail. Maintenance station 70 includes a cleaning station 200 that is configured to confront the nozzle face 114 across a gap 250. Face normal direction 58 is perpendicular to nozzle face 114. Gap 250 has a gap height H along face normal direction 58. Cleaning station 200 includes a cleaning fluid dispenser 220 containing a cleaning fluid 221. In the example shown in FIG. 4, cleaning fluid dispenser 220 includes a spray head 222 having a plurality of openings for providing a spray 225 of cleaning fluid 221 across the gap 250, thereby providing dispensed cleaning fluid 223 on nozzle face 114. A dispenser pressure source 228 provides pressure on a cleaning fluid source 226 in order to cause spray 225 of cleaning fluid 221 to be emitted from spray head 222. The dispensed cleaning fluid 223 mixes with ink residue and loosened debris on the nozzle face 114 to produce waste fluid 235. Cleaning station 200 includes a waste collector 230 having a vacuum inlet 233 that is displaced from the cleaning fluid dispenser 220 in a first direction for collecting waste fluid 235. In the example shown in FIG. 4, the first direction is parallel to array direction 54. The vacuum inlet 233 has a first edge 231 that is proximate to the cleaning fluid dispenser 220, and a second edge 232 that is distal to the cleaning fluid dispenser 220. A vacuum source 238 draws waste fluid 235 through the vacuum inlet 233 and into a waste fluid container 236. Cleaning station 200 further includes a blower 210 that is displaced from the cleaning fluid dispenser 220 in a second direction opposite to the first direction, i.e. opposite to array direction 54 in the example shown in FIG. 4. Blower 210 is configured to direct a gas stream 215, such as air, along the nozzle face 114 to move dispensed cleaning fluid 223 toward the vacuum inlet 233. A blower pressure source 218 is connected to blower 210. As the dispensed cleaning fluid 223 moves along the nozzle face 114, it picks up additional ink residue and loosened debris to produce the waste fluid 235 that is suctioned away by vacuum inlet 233.

Also shown in FIG. 4 is a pressure source 260, which is fluidically coupled to ink source 190 by pressure line 262. Pressure source 260 is configured to controllably provide a positive pressure or a negative pressure to the ink source 190. Pressure source 260 typically includes at least one pump that is fluidically coupled to ink source 190 by pressure line 262.

An important aspect of embodiments of the invention is valve 265 that is fluidically connected between the ink source 190 and the inkjet printhead 50. The valve includes an on position and an off position, which are controllably selectable by maintenance control unit 19 of controller 14 (FIG. 2). During printing, valve 265 is in the on position in order to let ink flow from ink source 190 to printhead 50 through ink supply line 264. During operation of cleaning station 200, valve 265 is in the off position, thereby isolating printhead 50 from ink source 190. Isolating printhead 50 from ink source 190 by closing valve 265 provides several important functions. Firstly, it helps to prevent dispensed cleaning fluid 223 from migrating into ink source 190, thereby diluting the ink. Secondly, the closed valve 265 helps to keep gas stream 215 from depriming the nozzles 32 (FIG. 2) in nozzle face 114. Thirdly, the closed valve prevents excessive ink from being siphoned or suctioned into vacuum inlet 233 along with waste fluid 235.

Also shown in FIG. 4 is mover 270. Mover 270 moves the cleaning station 200 relative to printhead 50 along the array direction 54. The dispensed cleaning fluid 223 covers nozzles 32 in only a limited portion of the nozzle face 114. By moving the cleaning station 200 relative to the printhead 50 along the array direction 54, all of the nozzles 32 in printhead 50 can be cleaned. Mover 270 can move the cleaning station 200 while the printhead 50 is stationary, or mover 270 can move the printhead 50 while the cleaning station 200 is stationary.

Figure 5:
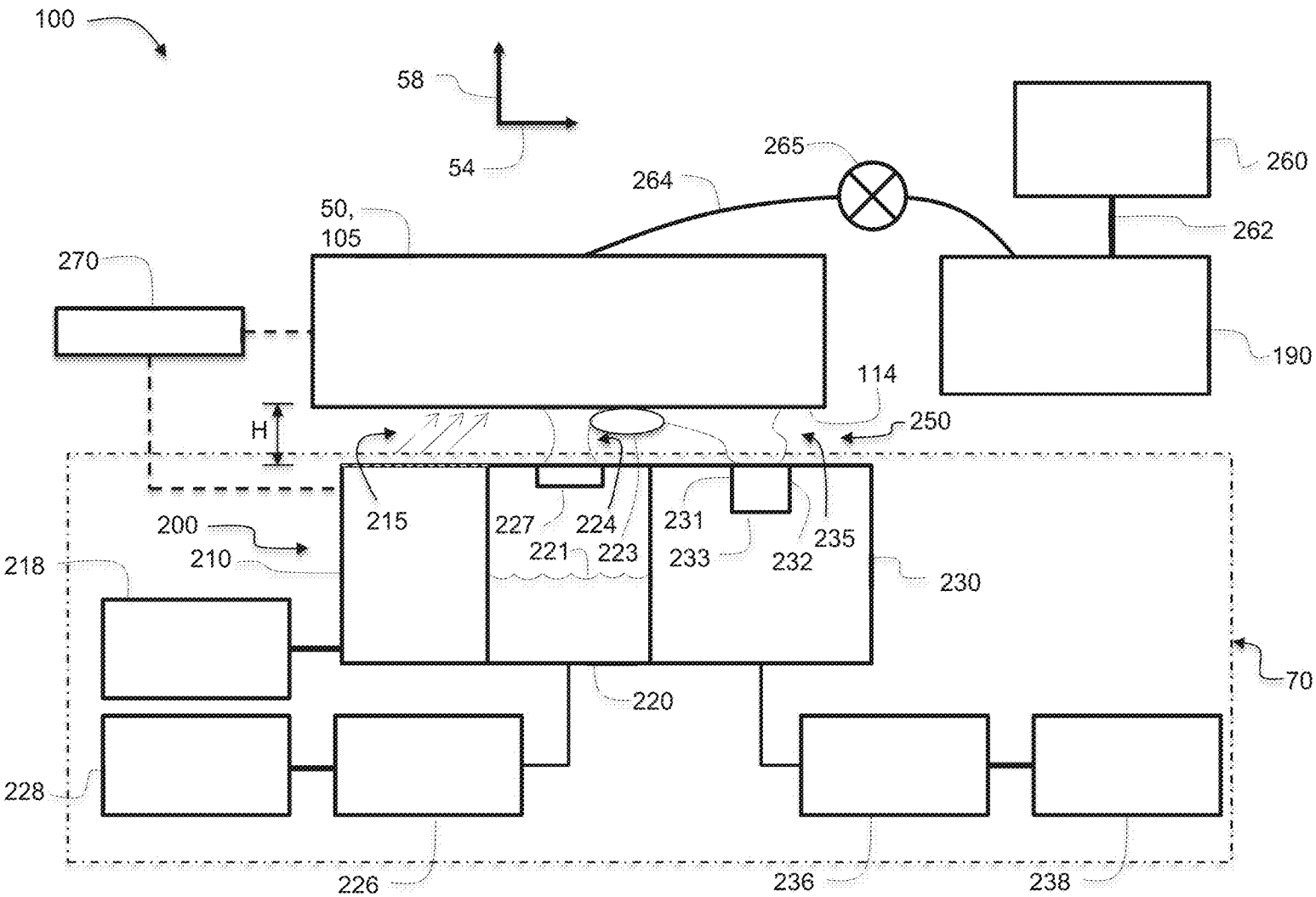
FIG. 5 shows a schematic of a portion of an inkjet printing system including a cleaning station according to another embodiment of the invention.

FIG. 5 shows a schematic of another embodiment where spray head 222 of FIG. 4 is replaced by dispenser outlet 227, which includes one or more round or elongated openings for example. Dispenser outlet 227 is configured to provide a meniscus bridge 224 of cleaning fluid 221 across the gap 250 to the nozzle face 114. In this embodiment, dispenser pressure source 228 provides sufficient pressure on cleaning fluid source 226 to cause cleaning fluid 221 to bulge outwardly from dispenser outlet 227 into the gap 250. When the bulge of cleaning fluid 221 contacts nozzle face 114, a meniscus bridge 224 of cleaning fluid 221 is formed, the shape of which depends on surface tension of the cleaning fluid 221 as well as surface wetting properties of the nozzle face 114 and the dispenser outlet 227. The meniscus bridge 224 provides the dispensed cleaning fluid 223 that is directed along the nozzle face 114 by the gas stream 215 from blower 210. As described above with reference to FIG. 4, the dispensed cleaning fluid 223 is directed by gas stream 215 along the nozzle face 114. It picks up additional ink residue and loosened debris and is suctioned away as waste fluid 235 by vacuum inlet 233.

Next described is a method of using the cleaning station 200 (FIGS. 4 and 5) to clean a nozzle face 114 and associated nozzles 32 for a printhead 50 such as a pagewidth printhead 105 (FIG. 3) that is fluidically connected to an ink source 190 and to a pressure source 260 through a valve 265. Pressure source 260 applies a small positive pressure to the ink source 190 that is sufficient to cause ink in the pagewidth printhead 105 to weep from nozzles 32 that are arranged in nozzle region 116 along array direction 54 in the nozzle face 114. Valve 265 is then closed to stop the weeping of ink and to prevent siphoning through the nozzles 32. Pressure source 260 can then be turned off. Cleaning fluid dispenser 220 dispenses cleaning fluid 221 onto the nozzle face 114. For the cleaning fluid dispenser 220 in the example shown in FIG. 4, dispensing of the cleaning fluid 221 includes spraying cleaning fluid 221 onto the nozzle face 114. For the cleaning fluid dispenser 220 in the example shown in FIG. 5, dispensing of the cleaning fluid 221 includes forming a meniscus bridge 224 between the cleaning fluid dispenser 220 and the nozzle face 114. Blower 210 blows the dispensed cleaning fluid 223 along the nozzle face 114 to mix with contaminants such as ink residue and debris to produce waste fluid 235. Vacuum source 238, which is connected to a vacuum inlet 233 of a waste collector 230, is turned on such that the waste fluid 235 is caused to enter the vacuum inlet 233. During the steps of dispensing cleaning fluid 221, blowing dispensed cleaning fluid 223 and vacuuming waste fluid 235, mover 270 can be used to move the cleaning station 200 relative to the pagewidth printhead 105 along the array direction 54. After all of the nozzles 32 in the nozzle faces 114 of the drop ejector array modules 110 have been cleaned, the dispensing of cleaning fluid 221 and the blowing of dispensed cleaning fluid 223 are ceased and the vacuum source 238 is turned off. A small negative pressure can be applied to the ink source 190 by pressure source 260 in order to keep the ink from weeping from the nozzles 32, and the valve 265 is opened in preparation for printing. Relative movement of the cleaning station 200 and the pagewidth printhead 105 can be stopped before opening the valve 265. Optionally, controller 14 initiates a number of spitting cycles for the drop ejectors 125 whose nozzles 32 have just been cleaned, in order to eject ink that is mixed with dispensed cleaning fluid 223 or waste fluid 235, so that the drop ejectors 125 contain substantially undiluted ink for printing.

Figure 6:
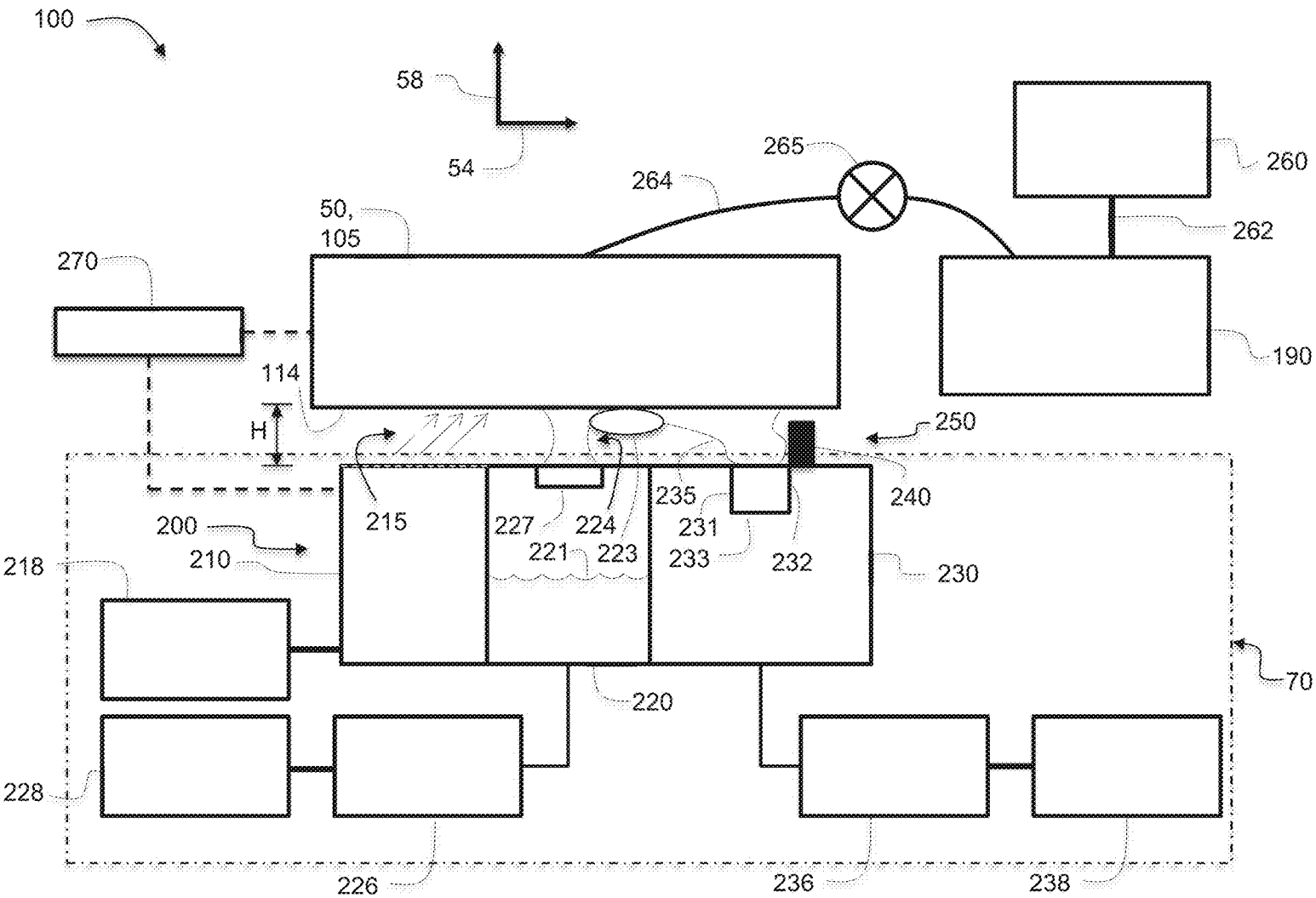
FIG. 6 shows a schematic of a portion of an inkjet printing system including a cleaning station and a baffle according to an embodiment of the invention.

FIG. 6 shows a schematic of a portion of inkjet printing system 100 according to another embodiment of the invention. Printhead 50 can be a pagewidth printhead 105 as described above with reference to FIG. 3. The embodiment shown in FIG. 6 is similar to that shown in FIG. 5, and also includes a baffle 240 that is disposed adjacent to the vacuum inlet 233 and opposite to the cleaning fluid dispenser 220. Baffle 240 is proximate to the second edge 232 of the vacuum inlet 233 and extends from the cleaning station 200 partially across the gap 250. Baffle 240 does not make contact with the nozzle face(s) 114 while mover 270 moves the cleaning station 200 relative to pagewidth printhead 105 along the array direction 54, so that the baffle 240 does not scrape against the nozzle face(s) 114. The function of baffle 240 is to improve the effectiveness of collection of waste fluid 235 by waste collector 230, by serving as a barrier against waste fluid 235 being blown past vacuum inlet 233.

Figure 7:
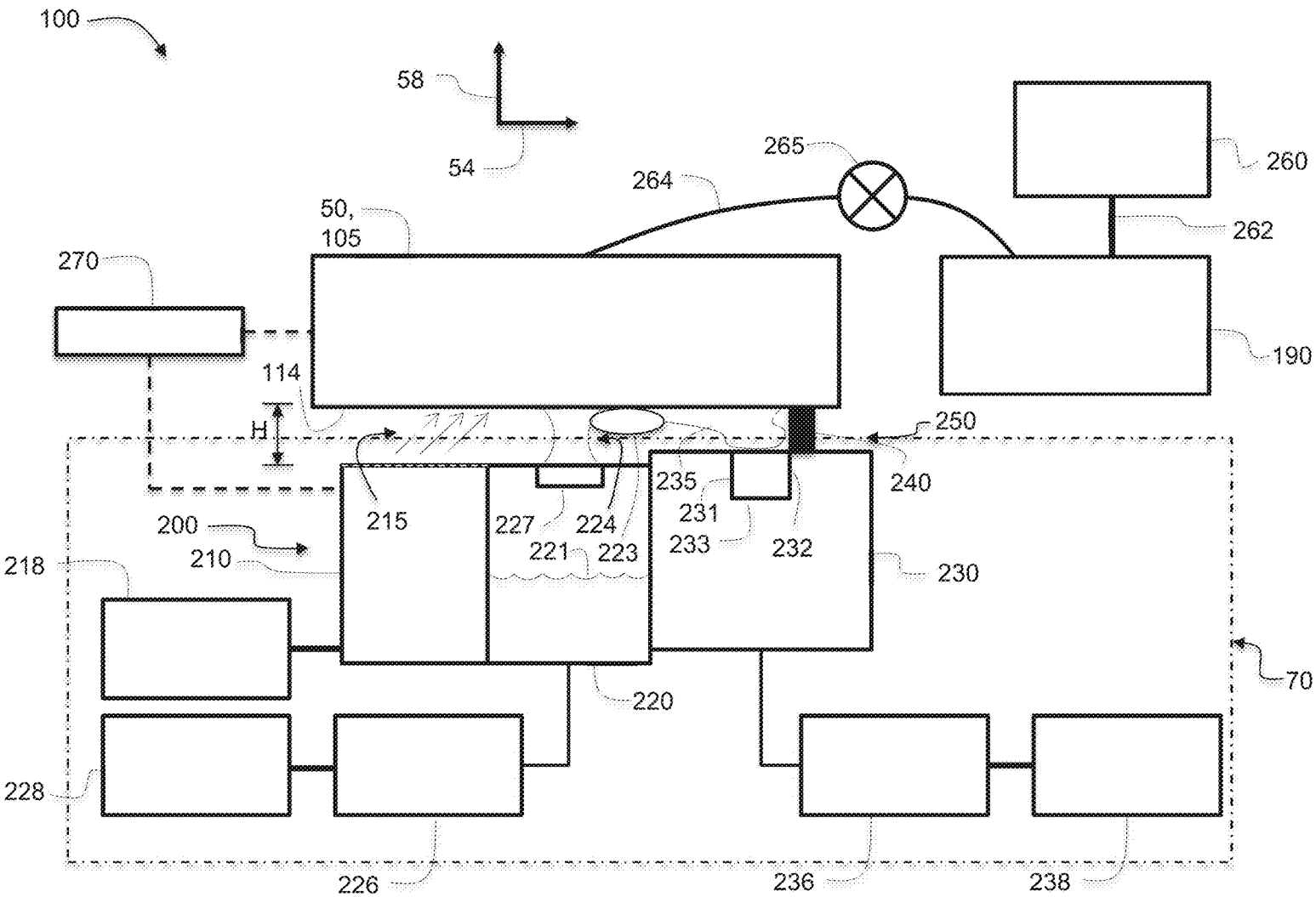
FIG. 7 is similar to FIG. 6, where the baffle has been moved into contact with the printhead.

In some embodiments including a baffle 240, the baffle 240 can be moved along face normal direction 58 into contact with the pagewidth printhead 105. FIG. 7 shows an example of moving the waste collector 230 together with the baffle 240 so that the baffle 240 is in contact with the pagewidth printhead 105. In other examples (not shown), the entire cleaning station 200 can be moved with the baffle 240. In some embodiments, mover 270 can move the baffle 240 and associated components of the cleaning station 200 along the face normal direction 58. In other embodiments (not shown) a second mover can move the baffle 240 and associated components of the cleaning station 200 along the face normal direction 58. Moving the baffle 240 into contact with the pagewidth printhead 105 is typically done after motion of the cleaning station 200 relative to pagewidth printhead 105 along the array direction 54 is stopped. In such cases, the baffle 240 can be brought into contact with pagewidth printhead 105 in the nozzle face region 116 or in the second region 117 outside the nozzle region 116 (FIG. 3).

With respect to the method of using the cleaning station described above with reference to FIGS. 4-5, the following steps can be added for embodiments that include a baffle 240 extending from the cleaning station adjacent to the vacuum inlet 233 and opposite to the cleaning fluid dispenser 220. It is understood the additional steps described here can apply to printheads 50 including pagewidth printheads 105. Baffle 240 is not in contact with the nozzle face(s) of the printhead 50 during the step of moving the cleaning station relative to the printhead 50 along the array direction 54. Baffle 240 can be moved along face normal direction 58 into contact with the printhead 50 after stopping the dispensing of the cleaning fluid 221. The steps of blowing the dispensed cleaning fluid 223 along the nozzle face 114 and vacuuming the waste fluid 235 through the vacuum inlet 233 can be continued after moving the baffle 240 along face normal direction 58 into contact with the printhead 50. In particular, the baffle 240 can be moved into contact with the printhead 50 in a second region 117 outside the nozzle region 116 (FIG. 3). For embodiments where the baffle 240 is moved into contact with the with the printhead 50 in the second region 117 outside the nozzle region 116, the cleaning station 200 can be moved relative to the printhead 50 along the array direction 54 after the baffle 240 is in contact with the printhead 50 in order to remove residual waste fluid 235 in the second region 117. The baffle 240 can scrape against the second region 117 without doing damage to the nozzle face 114 in the nozzle region 116. After the residual waste fluid 235 has been removed, the dispensing of cleaning fluid 221 and blowing dispensed cleaning fluid 223 can be ceased and the vacuum source 238 can be turned off as described above with reference to FIGS. 4-5.

Baffle 240 is an example of a contactable member that is movable along face normal direction 58 across the gap 250 from a first position (as shown in FIG. 6) where the contactable member is out of contact with the printhead 50 to a second position (as shown in FIG. 7) where the contactable member is in contact with the printhead 50. Other examples of contactable members include wipers and gaskets as in the embodiment described below with reference to FIG. 8.

Figure 8:
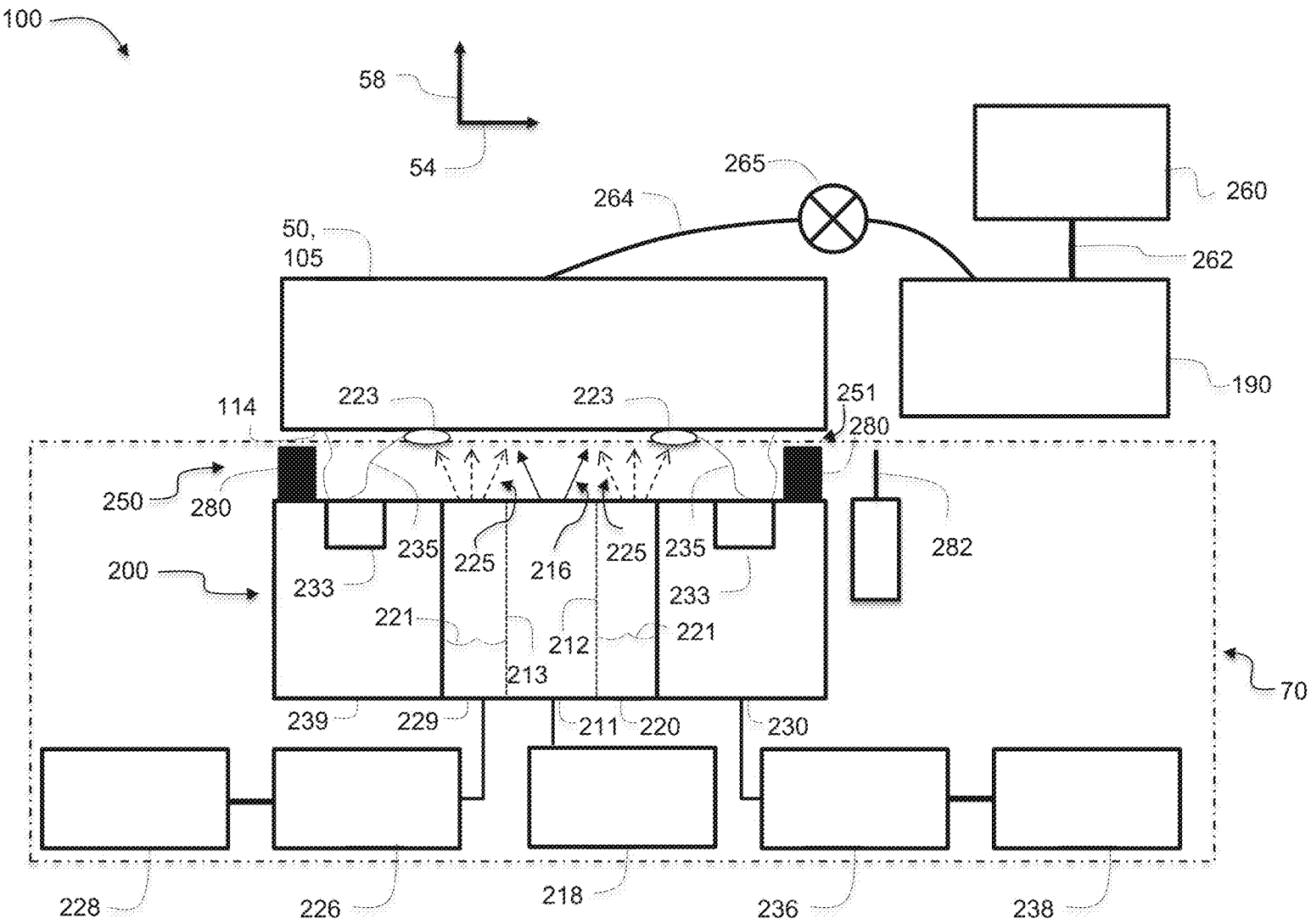
FIG. 8 shows a schematic of a portion of an inkjet printing system including a cleaning station having a symmetrical arrangement of its components.

In the embodiment shown in FIG. 8, the cleaning station 200 has a symmetrical arrangement of its blower, cleaning fluid dispensers and waste collectors. A central blower 211 is provided for directing a diverging gas stream 216 along the nozzle face 114 both along a first direction and a second direction that is opposite the first direction. In FIG. 8, the solid arrow in diverging gas stream 216 that inclines toward the right will be directed substantially along the array direction 54 after encountering the nozzle face 114, while the solid arrow in diverging gas stream 216 that inclines toward the left will be directed substantially opposite the array direction 54 after encountering the nozzle face 114. In the example shown in FIG. 8 the first direction is parallel to the array direction 54 and the second direction is opposite the array direction 54. Blower pressure source 218 is connected to central blower 211. A first cleaning fluid dispenser 220 is located adjacent to a first side 212 of the central blower 211. A second cleaning fluid dispenser 229 is provided and located adjacent to a second side 213 of the central blower 211 opposite the first cleaning fluid dispenser 220. A dispenser pressure source 228 provides pressure on a cleaning fluid source 226 in order to cause a spray 225 of cleaning fluid 221 to be emitted from both first cleaning fluid dispenser 220 and second cleaning fluid dispenser 229. In other embodiments, the cleaning fluid 221 can form a meniscus bridge 224 as in the example shown in FIG. 5. A first waste collector 230 is located adjacent to the first cleaning fluid dispenser 220 opposite to the central blower 211. A second waste collector 239 is provided and located adjacent to the second cleaning fluid dispenser 229 opposite to the central blower 211. As shown in FIG. 8, the diverging gas stream 216 moves dispensed cleaning fluid 223 from the first cleaning fluid dispenser 220 toward the vacuum inlet 233 of first waste collector 230, and also moves dispensed cleaning fluid 223 from the second cleaning fluid dispenser 229 toward the vacuum inlet 233 of second waste collector 239. As described above, the dispensed cleaning fluid 223 mixes with residual ink and debris to produce waste fluid 235. Waste fluid 235 is suctioned away by vacuum inlet 233 of first waste collector 230 and by vacuum inlet 233 of second waste collector 239.

Also shown in FIG. 8 is a gasket 280 that is provided around the cleaning station 200. In the example shown in FIG. 8, gasket 280 is not in contact with the printhead 50. Cleaning station 200 and gasket 280 can be moved along face normal direction 58 to decrease a gap 251 between the printhead 50 and the gasket 280. For example, the gap 251 can be decreased prior to applying positive pressure to the ink source 190 to cause ink weeping at the beginning of the cleaning operation. The gap 251 can be decreased to zero to bring the gasket 280 into contact with the printhead 50 prior to pressurizing the ink source 190. The gap 251 can also be decreased to zero to bring the gasket 280 into contact with the printhead 50 when printing is not being done, in order to cap the printhead to reduce the evaporation of volatile components of the ink. FIG. 8 also shows a wiper 282 that can be moved independently from cleaning station 200 along the face normal direction 58 to position the wiper 282 to be in contact with the printhead 50 or nozzle face 114 occasionally, or to position the wiper 282 to be out of contact with the printhead 50 or nozzle face 114.

Figure 9:
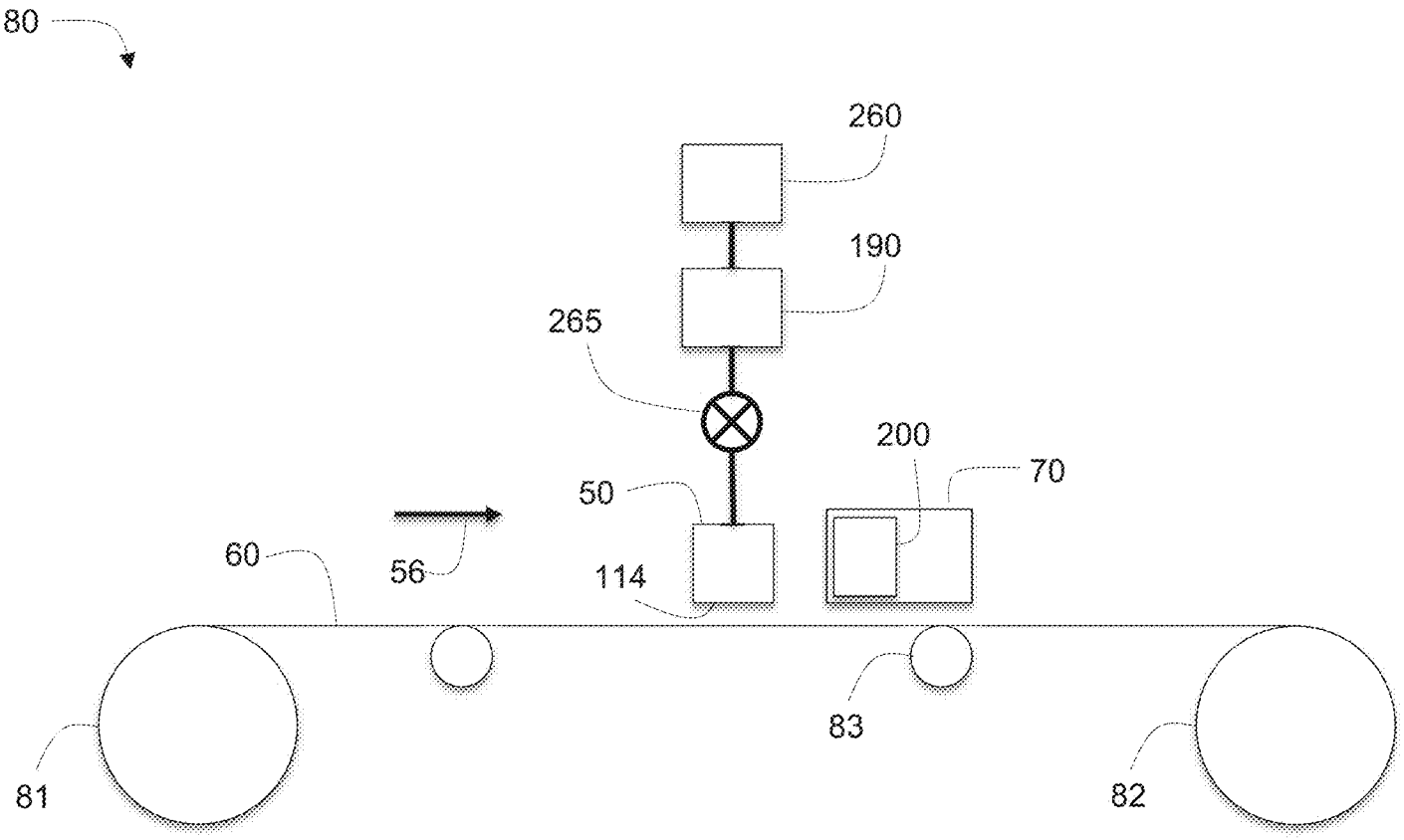
FIG. 9 shows a roll-to-roll printing system including a printhead and cleaning station according to an embodiment.

FIG. 9 schematically shows an example of a roll-to-roll printing system 80 that having an inkjet printhead 50 and a maintenance station 70 including a cleaning station 200 as described in embodiments above. A stationary inkjet printhead 50 is in fluidic communication with an ink source 190 through valve 265. Ink source 190 is also connected to pressure source 260. A web of recording medium 60 is advanced from a source roll 81 to a take-up roll 82 along scan direction 56 and is guided by one or more rollers 83. Printhead 50 is long enough to span the web of recording medium 60, or at least the portion of recording medium 60 that is to be printed. During printing, the nozzle face 114 of printhead 50 is positioned and oriented to print drops of ink onto recording medium 60. During cleaning, the nozzle face 114 of printhead 50 is positioned and oriented such that the cleaning station 200 confronts the nozzle face 114 across a gap. In the example shown in FIG. 9, the printhead 50 can be rotated counter-clockwise by ninety degrees to orient the nozzle face 114 for cleaning by cleaning station 200. In other printing system configurations (not shown) the printhead 50 can be moved away from the web of recording medium 60, and the maintenance station 70 including the cleaning station 200 can be moved between the printhead 50 and the web of recording medium 60 in order to clean the printhead 50. In still other printing system configurations (not shown), the maintenance station 70 including the cleaning station 200 can be offset from the web of recording medium 60 along the array direction 54. The printhead 50 can be moved along the array direction 54 (i.e. into or out of the plane of FIG. 9) to position the printhead 50 for cleaning by the cleaning station 200. In yet other printing system configurations (not shown), tension can be removed from the web of recording medium 60 so that it is allowed to sag below printhead 50. In such embodiments, the printhead 50 can remain stationary while cleaning station 200 is moved beneath printhead 50 so that cleaning station 200 can scan along array direction 54 in order to clean nozzle face 114.

With reference to FIG. 8 a method of using a cleaning station 200 to clean a nozzle face 114 of an inkjet printhead 50 can be described as follows: Printhead 50 is moved relative to cleaning station 200 along face normal direction 58 such that the gasket 280 is in contact with the printhead 50 near the nozzle face 114. Optionally there can be a small gap between gasket 280 and the printhead 50. With valve 265 open, a small positive pressure is applied to the ink source 190 by pressure source 260 in order to cause ink weeping from the nozzles 32 (FIG. 2). The valve 265 is then closed to stop ink weeping and prevent siphoning or suction of ink from the nozzles 32. The pressure source is then turned off. Cleaning fluid 221 is dispensed onto the nozzle face 114. Dispensed cleaning fluid 223 is blown along the nozzle face 114 toward one or more vacuum inlets 233, and waste fluid 235 is suctioned by one or more waste collectors 230 or 239. In embodiments where the printhead 50 is not very long, the gasket 280 can surround the entire nozzle region 116 (FIG. 3) so that it is not necessary to move the cleaning station 200 relative to the printhead 50 along the array direction 54. When all of the nozzles 32 have been cleaned, the dispenser pressure source 228 is turned off. Optionally, the blower pressure source 218 can remain on sufficiently long to blow away the remaining dispensed cleaning fluid 223 and waste fluid 235 away from the nozzle face 114. Then the blower pressure source 218 and the vacuum source 238 are turned off. A small negative pressure is applied to the ink source 190 by the pressure source 260, and the valve 265 is opened in preparation for printing. Optionally, maintenance control unit 19 of controller 14 (FIG. 2) initiates a number of spitting cycles for the drop ejectors 125 whose nozzles 32 have just been cleaned, in order to eject ink that is mixed with dispensed cleaning fluid 223 or waste fluid 235, so that the drop ejectors 125 contain substantially undiluted ink for printing.

In the embodiments described above with reference to FIGS. 4-7 the vacuum inlet 233 of the waste collector 230 is displaced from the cleaning fluid dispenser 220 in a first direction that is parallel to the array direction 54, and the blower 210 is displaced from the cleaning fluid dispenser 220 in a second direction that is opposite to the array direction 54. Such a configuration causes dispensed cleaning fluid 223 to be moved along the nozzle face 114 in the array direction 54. In other embodiments the vacuum inlet 233 of the waste collector 230 is displaced from the cleaning fluid dispenser 220 in a first direction that is perpendicular to the array direction 54, and the blower 210 is displaced from the cleaning fluid dispenser 220 in a second direction that is opposite the first direction. Such a configuration causes the dispensed cleaning fluid 223 to be moved along the nozzle face 114 along scan direction 56 (FIG. 3). In still other embodiments the first direction is neither parallel to nor perpendicular to the array direction 54.

The invention has been described in detail with particular reference to certain preferred embodiments thereof, but it will be understood that variations and modifications can be effected within the spirit and scope of the invention

The invention claimed is:

1. An inkjet printing system comprising:

an inkjet printhead including a nozzle face having nozzles arranged along an array direction;

an ink source;

a controller a pressure source that is configured to controllably and selectively provide both a positive pressure and a negative pressure to the ink source;

a valve that is fluidically connected between the ink source and the inkjet printhead, the valve including an on position and an off position, wherein the on position and the off position are controllably selectable, and wherein the off position of the valve is configured to isolate the printhead from both positively pressurized and negatively pressurized ink; and a cleaning station that is configured to confront the nozzle face across a gap, the cleaning station including:

a cleaning fluid dispenser containing a cleaning fluid and at least one opening for dispensing cleaning fluid onto the nozzle face;

a waste fluid collector having a vacuum inlet that is displaced from the cleaning fluid dispenser in a first direction for collecting dispensed cleaning fluid, wherein the vacuum inlet has a first edge that is proximate to the cleaning fluid dispenser and a second edge that is distal to the cleaning fluid dispenser; and a blower that is displaced from the cleaning fluid dispenser in a second direction opposite to the first direction, wherein the blower is configured to direct a gas stream along the nozzle face to move dispensed cleaning fluid toward the vacuum inlet.

2. The inkjet printing system of claim 1, wherein the first direction is parallel to the array direction.

3. The inkjet printing system of claim 1, wherein the pressure source includes at least one pump that is fluidically coupled to the ink source.

4. The inkjet printing system of claim 1 further comprising a mover for moving the cleaning station along the array direction.

5. The inkjet printing system of claim 1, wherein the cleaning fluid dispenser includes a spray head.

6. The inkjet printing system of claim 1, wherein the cleaning fluid dispenser is configured to provide a meniscus bridge of cleaning fluid across the gap to the nozzle face.

7. The inkjet printing system of claim 1, wherein the cleaning station further includes a baffle that is disposed proximate to the second edge of the vacuum inlet, and wherein the baffle extends partially across the gap without making contact with the nozzle face.

8. The inkjet printing system of claim 1 further comprising a contactable member that is movable across the gap from a first position where the contactable member is out of contact with the printhead to a second position where the contactable member is in contact with the printhead.

9. The inkjet printing system of claim 1 further comprising a web of recording medium that can be advanced from a source roll to a take-up roll, wherein the nozzle face of the inkjet printhead can be positioned and oriented for printing drops of ink onto the recording medium.

10. The inkjet printing system of claim 9, wherein the nozzle face of the printed can be positioned and oriented such that the cleaning station confronts the nozzle face across the gap.

11. A method of using a cleaning station to clean a nozzle face of an inkjet printhead that is fluidically connected to an ink source through a valve, the ink source being connected to a pressure source, the method comprising:

applying a positive pressure to the ink source from the pressure source to cause ink to weep from nozzles that are arranged in a nozzle region along an array direction in the nozzle face;

closing the valve to stop the weeping of ink and to prevent siphoning through the nozzles;

turning on a vacuum source that is connected to a vacuum inlet of a waste collector;

dispensing cleaning fluid onto the nozzle face after turning on the vacuum source;

blowing the dispensed cleaning fluid along the nozzle face to produce waste fluid;

vacuuming the waste fluid through the vacuum inlet;

ceasing the dispensing of cleaning fluid;

ceasing the blowing of dispensed cleaning fluid;

turning off the vacuum source after ceasing the dispensing of cleaning fluid;

applying a negative pressure to the ink source from the pressure source; and opening the valve in preparation for printing.

* * * * *